United States Patent [19]

Hembree et al.

[11] 4,196,540

[45] Apr. 8, 1980

[54] AERODYNAMIC TOY

[76] Inventors: Charles B. Hembree; Brian T. Shea, both of P.O. Box 942, El Cerrito, Calif. 94530

[21] Appl. No.: 828,176

[22] Filed: Aug. 26, 1977

Related U.S. Application Data

[63] Continuation-in-part of Ser. No. 712,016, Aug. 5, 1976, abandoned.

[51] Int. Cl.[2] ..... A63H 27/00

[52] U.S. Cl. ..... 46/74 D; 273/424

[58] Field of Search ..... 46/74 D; 273/106 B

[56] References Cited

U.S. PATENT DOCUMENTS

| | | | |
|---|---|---|---|
| 3,359,678 | 12/1967 | Headrick | 46/74 D |
| 3,710,505 | 1/1973 | Lininfelser | 46/74 D |

*Primary Examiner*—Russell R. Kinsey
*Assistant Examiner*—Mickey Yu
*Attorney, Agent, or Firm*—Bielen and Peterson

[57] ABSTRACT

An aerodynamic toy having a central portion of circular configuration and a peripherally connecting rim portion. The central portion has a flat top surface while the connected rim portion has a rounded surface. The flat top surface of the central portion is contiguous with the rounded edge portion. The toy is constructed of a soft, flexible, foam material of substantially uniform density.

8 Claims, 3 Drawing Figures

AERODYNAMIC TOY

CROSS REFERRENCES TO RELATED INVENTIONS

The present invention is a continuation-in-part of my co-pending patent application Ser. No. 712,016, filed 5 Aug. 1976 now abandoned.

BACKGROUND OF THE INVENTION

The present invention relates to aerodynamic toys.

Spherical shaped objects have been employed in many games and sports. A relatively modern development has produced a gliding toy in the shape of a disc, for example U.S. Pat. No. 3,359,678. Such a toy is typically hurled by flicking of the same away from the user's body. This throwing action imparts rotational motion to the disc which stabilizes the flight characteristics thereof.

The usual embodiment of saucer-like toys calls for a relatively hard plastic material. Such saucer toys are well suited for the outdoor environment where a great deal of open space exists and winds are likely to occur. However, prior saucer-like toys are not readily usable indoors since their high velocity may cause injury to persons and property. In addition, crowded outdoor areas are not compatible with free wheeling use of the hard plastic saucer-like toys. Moreover, younger children find it difficult to manipulate a saucer-like toy of the prior art because of the level of strength required to properly propel the disc. Also, persons of all ages are prone to injury caused by the repeated rubbing of the disc as it leaves the hand of the user.

None of the prior aerodynamic toys exhibits stability and flight at low speeds, and softness which permits its use in confined areas.

SUMMARY OF THE INVENTION

In accordance with the present invention, a novel and useful aerodynamic toy is provided, utilizing a central portion of circular configuration. The central portion has a substantially flat top surface and a thickness less than its diameter. Connected to the circular central portion is a rim portion of greater thickness than the central portion. The exterior surface of the rim portion is smooth, continuous and rounded. The flat top surface of the central portion and the rounded outer surface of the rim portion form a continuous or uninterrupted surface. The aerodynamic toy of the present invention is constructed of soft, flexible, foam material of substantially uniform density.

An embodiment of the present invention provides for the integral construction of the central portion and the rim portion heretofore described. The rim portion may also be essentially semi-circular in cross-sectional configuration.

It may be surmised that a novel and useful aerodynamic toy has been described and it is therefore an object of the present invention to provide such a toy capable of traveling at slower speeds than aerodynamic toys of the prior art while maintaining equal gyroscopic stability.

It is another object of the present invention to provide an aerodynamic toy which can be thrown indoors or in confined areas without damaging persons or objects within such areas.

It is yet another object of the present invention to provide an aerodynamic toy which does not injure the thrower's hand as a result of the tossing action required to cause the aerodynamic toy to fly.

It is another object of the present invention to provide an aerodynamic toy which requires less skill, strength, and experience to throw and catch than the hard saucer-like toys of the prior art.

It is still another object of the present invention to provide an aerodynamic toy which may be easily and safely rebounded on hard surfaces.

Another object of the present invention is to provide an aerodynamic toy which can be inexpensively and easily manufactured.

The present invention possesses other objects and advantages, especially as concerns particular features and characteristics, which will become apparent as the specification continues.

The invention and its embodiments may be better understood by reference to the accompanying drawings described hereinafter.

DESCRIPTION OF THE PREFERRED EMBODIMENTS

Figure 1:
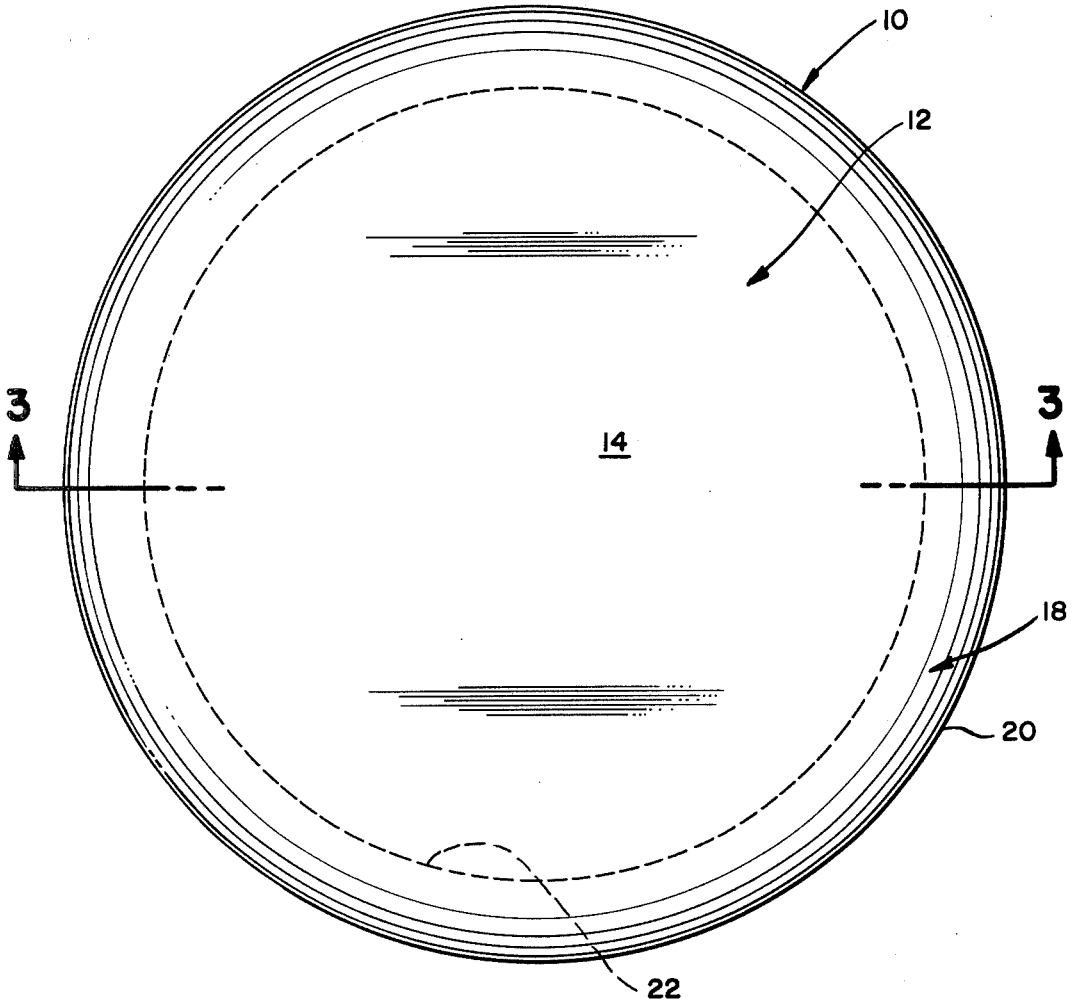
FIG. 1 is a top plain view of the invention.
Figure 2:
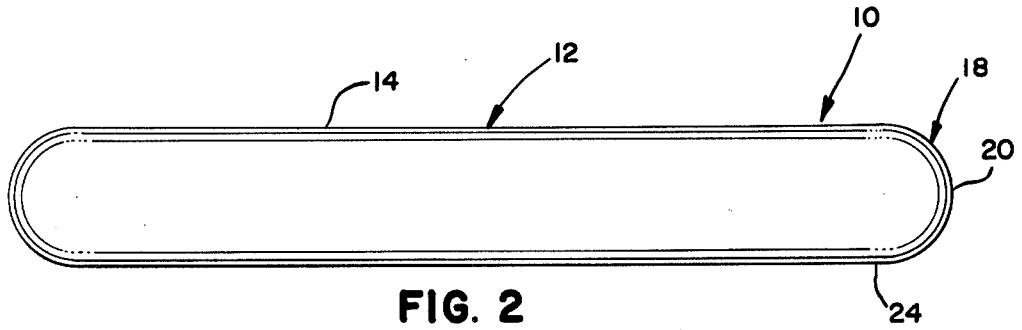
FIG. 2 is a side elevational view of the invention.
Figure 3:
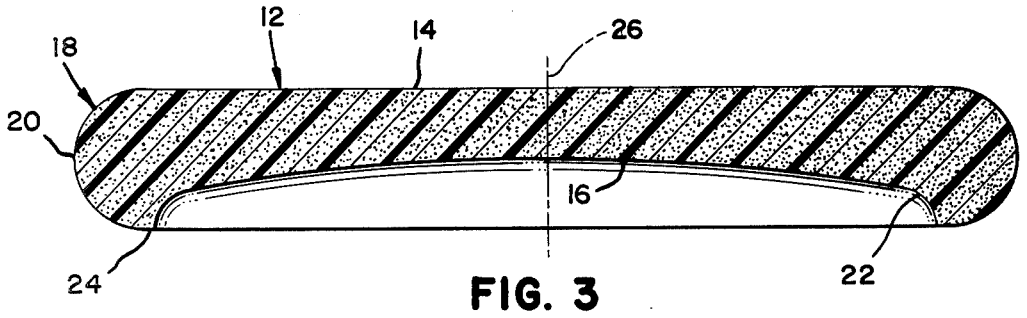
FIG. 3 is a view taken along line 3—3 of FIG. 1.

The present invention as a whole is identified in the drawings by reference character 10 and includes a central portion 12 of circular configuration, FIG. 1. Central portion 12 includes a top surface 14 and a bottom surface 16, best seen in FIG. 3. Top surface 14 of central portion 12 is substantially flat. Bottom portion 16 of central portion 12 may be constructed as being flat (not shown) or having a slightly concave contour. The thickness of central portion 12 is less than its diameter, generally ranging between one-eighth and one-twentieth of the diameter thereof.

Rim portion 18 connects to the periphery of circular central portion 12. As may be observed from FIG. 3, rim portion 18 has a thickness greater than the thickness of central portion 12. Generally, the thickness of central portion 12 is between one half and three quarters of the thickness of rim portion 18. Rim portion 18 includes an outer convex surface 20 and an inner concave surface 22. The lowest depending part of rim portion 18 terminates in a relatively flat surface 24. Outer convex surface 20 of rim portion 18 extends as high as flat top surface 14 of central portion 12. Surface 14 and surface 20 form an uninterupted surface, in that there is a smooth merger of both surfaces. Rim portion 18 is smooth, continuous and rounded and may take the form of the embodiment shown in the figures, ie: a semi-circular cross-sectional configuration.

The toy 10 of the present invention is formed of a soft flexible foam material such as, but not limited to, polyester or polyether plastic. The foam material in the preferred embodiment has a density ranging from 16 kilograms per cubic meter to 60 kilograms per cubic meter. The optimum density of such foam material is in the range of 16 kilograms per cubic meter to 48 kilograms per cubic meter. The geometric relationship of rim portion 18 to central portion 12 shifts a good deal of the mass of the toy 10 perpendicular to axis 26, about which toy 10 rotates. This additional weight at rim portion 18 of toy 10 increases the moment of inertia of toy 10 in its spinning flight mode.

Circular central portion 12 and rim portion 18 are preferably integrally formed. The resulting toy 10 presents a smooth, continuous surface to the air medium through which it flies. Surfaces 14, 16, and 20 may be constructed of open cell foam, unmarred by heat treatment of any kind. The toy 10 of the preferred embodiment is carved or cut from a single piece of foam of substantially uniform density. It may be understood that other methods known to persons of ordinary skill in the art may be employed to form the toy 10 of the present invention, as long as substantially uniform density of the finished product is maintained in such a process. For example, forming toy 10 by a molding process would produce a slight increase of density of the surface of toy 10. The present invention's substantial uniform density is deemed to include this situation.

In operation, the user grabs the toy by placing his thumb on either the top surface 14 of central portion 12 or outer portion 20 of rim portion 18. The remaining fingers of the user's hand rest on flat surface 24 or bottom surface 16 of central portion 12. The entire toy is propelled outwardly from the body of the user with concurrent rotation of toy 10 about axis 26.

While in the foregoing specification embodiments of the invention have been set forth in considerable detail for purposes of making a complete disclosure of the invention, it will be apparent to those of ordinary skill in the art that numerous changes may be made in such detail without departing from the spirit and principals of the invention.

What is claimed is :

1. An aerodynamic toy comprising:

a. a central portion of circular configuration having a substantially flat top surface and a thickness of less than the diameter of said central portion, said central portion having a lower concave surface;

b. a rim portion integrally formed with said circular central portion, said rim portion having a thickness greater than the thickness of said central portion, said rim portion having a smooth continuous, rounded outer surface which extends to said flat top surface of said central portion, said outer surface of said rim portion and said flat top surface of said central portion forming an uninterrupted surface, said central portion and said rim portion being constructed of a soft, flexible, foam material of uniform density.

2. The aerodynamic toy of claim 1 in which said soft, flexible, foam, material has a density ranging from sixteen (16) kilograms per cubic meter to forty-eight (48) kilograms per cubic meter.

3. The aerodynamic toy of claim 1 in which said soft, flexible, foam material has a density ranging from sixteen (16) kilograms per cubic meter to sixty (60) kilograms per cubic meter.

4. The aerodynamic toy of claim 1 in which said rim portion is essentially semicircular in cross-sectional configuration.

5. The aerodynamic toy of claim 4 in which said soft, flexible, foam, material has a density ranging from sixteen (16) kilograms per cubic meter to forty-eight (48) kilograms per cubic meter.

6. The aerodynamic toy of claim 4 in which said soft, flexible, foam, material has a density ranging from sixteen (16) kilograms per cubic meter to sixty (60) kilograms per cubic meter.

7. The aerodynamic toy of claim 4 in which said central portion and said rim portion are constructed of a soft, flexible, foam prepared from the group comprising polyester, and polyether.

8. The aerodynamic toy of claim 7 in which said soft, flexible, foam material has a density ranging from 19.2 kilograms per cubic meter to 22.4 kilograms per cubic meter.

* * * * *